United States Patent [19]

Koizumi et al.

[11] Patent Number: 4,844,942

[45] Date of Patent: Jul. 4, 1989

[54] METHOD OF PRODUCING DARK HEATER

[75] Inventors: Sachio Koizumi, Mobara; Terutoshi Ichihara, Chiba, both of Japan

[73] Assignees: Hitachi, Ltd.; Hitachi Nisshin Electronics Co., Ltd., Tokyo, Japan

[21] Appl. No.: 864,513

[22] Filed: May 19, 1986

[30] Foreign Application Priority Data

May 17, 1985 [JP] Japan ..... 60-103802

[51] Int. Cl.[4] ..... B05D 5/12

[52] U.S. Cl. ..... 427/111; 427/118; 427/120; 427/123; 427/126.3; 427/126.4; 427/372.2; 427/383.7; 427/404; 427/419.2; 427/435; 427/437

[58] Field of Search ..... 427/118, 419.3, 419.2, 427/376.4, 435, 437, 404, 205, 126.3, 190, 126.4, 141, 111, 383.7, 120, 123, 372.2

[56] References Cited

U.S. PATENT DOCUMENTS

| | | | |
|---|---|---|---|
| 3,691,421 | 9/1972 | Decker et al. | 427/118 |
| 3,808,043 | 4/1974 | Hale et al. | 427/380 |
| 3,852,105 | 12/1974 | Hale | 427/8 |
| 4,126,489 | 11/1978 | Williams | 427/118 |

*Primary Examiner*—Janyce Bell

*Attorney, Agent, or Firm*—Antonelli, Terry & Wands

[57] ABSTRACT

A dark heater is produced by a method which comprises coating the first coating layer made of an insulating material with a suspension containing heat-resistant particles having a high thermal emissivity, such as W particles, while 0.5 to 1.5 wt. % of a volatile matter such as water remains in the first coating layer to form a dark coating layer. Since the suspension having a low viscosity can be used, the thickness of the dark coating layer can be made highly uniform and the emission characteristics of the heater can be stabilized.

34 Claims, 2 Drawing Sheets

METHOD OF PRODUCING DARK HEATER

BACKGROUND OF THE INVENTION

The present invention relates to a method of producing a dark heater for an electron tube having an indirectly heated cathode, particularly, a dark heater having a black appearance.

A dark heater has been used usually for efficiently heating a thermoelectron-emissive cathode in an electron tube having an indirectly heated cathode.

Such a heater comprises, in general, a core wire made of a high-melting point metal such as tungsten, a first coating layer made of an insulating material such as aluminum oxide (alumina) and covering the core wire and a second, external coating layer, i.e. a dark coating layer, made of a mixture of tungsten and aluminum oxide (alumina) particles.

For the formation of the dark coating layer, a dip coating method has been known. In this method, the specific gravity, viscosity, etc. of a suspension bath must be controlled strictly and, particularly, the first alumina layer must be dried completely so as to prevent the deterioration of insulation between the heater and the cathode due to penetration of tungsten particles contained in the suspension bath into the first alumina layer as disclosed in the specifications of U.S. Pat. Nos. 3,808,043 and 3,852,105.

However, an installment such as a furnace is necessary for drying the first alumina layer completely and, therefore, the production cost is increased. Further, in forming the dark coating layer by the dip coating method on the first alumina layer thus dried, a bath having a high viscosity must be used so as to prevent penetration of the tungsten particles contained in the bath into alumina according to a capillary phenomenon. However, a large amount of the bath liquid is applied to the first layer in such a case to form a thick dark coating layer. As a result, the heat capacity is increased, so that the rise time is prolonged and, particularly, in a color picture tube, imbalance in display among three colors is likely to occur and the coating layers begin to peel away and are scattered on the performances of the tube. Further, the bath liquid is apt to stay at a bend of a worked heater to cause dispersion of the emission characteristics.

SUMMARY OF THE INVENTION

An object of the present invention is to provide a method of producing a dark heater wherein the particles having a high thermal emissivity in the suspension bath do not penetrate into the first coating layer even when the suspension bath having a viscosity lower than that of an ordinary suspension bath is used in forming the dark coating layer by overcoming the defects of the conventional processes. Another object of the invention is to provide a method of producing a dark heater having only a very slight unevenness of the thickness of the dark coating layer, i.e. highly uniform emission characteristics at a low cost.

The above-mentioned objects can be attained by the method of the present invention for producing the dark heater which comprises the steps of coating a core wire made of a heat-resistant conductive material with a heat-resistant insulating material and then coating the obtained first coating layer of the insulating material in which 0.5 to 1.5 wt. % of a volatile matter remains with a material containing heat-resistant particles having a high thermal emissivity to form the second coating layer, i.e. the dark coating layer. Thus, in the method of the present invention, the dark coating layer is formed after the formation of the first coating layer while 0.5 to 1.5 wt.% of a volatile matter such as water remains in the first coating layer or, in other words, without thoroughly drying the same.

When a suitable amount of water, etc. thus remains in the first coating layer, voids through which the bath liquid penetrates are divided into very fine bubbles by water drops, etc. to inhibit the penetration of the liquid into the first coating layer by the capillary phenomenon and, therefore, the penetration of tungsten particles is prevented.

According to the method of the present invention for producing the dark heater, the viscosity of the suspension bath used in forming the dark coating layer can be reduced to 10 to 12 cP.

The volatile matter content can be determined, for example, by measuring a weight change as well known in the art, or alternatively by a method which comprises previously examining the relationship between the drying time and the amount of the volatile matter, measuring the actual drying time and determining the amount of the volatile matter from the drying time. However, the methods of the determination of this amount are not limited to them.

DESCRIPTION OF THE PREFERRED EMBODIMENTS

Figure 1:
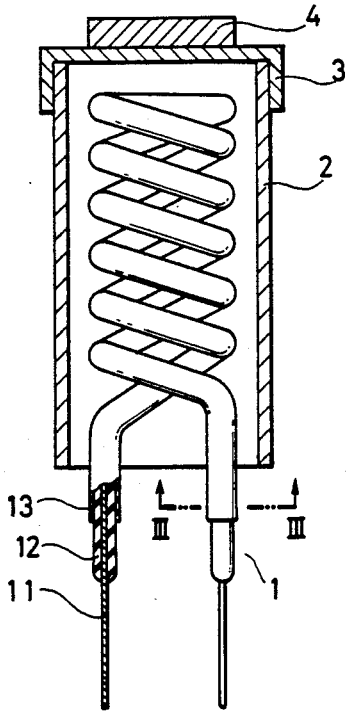
FIG. 1 is a partial, cross-sectional front view of an indirectly heated cathode for an electron tube in an embodiment of the present invention.

FIG. 1 is a partial, cross-sectional front view of an indirectly heated cathode for an electron tube in an embodiment of the invention. In this figure, numeral 1 refers to a dark heater having a double helical structure produced by coiling a tungsten wire around a molybdenum wire (not shown) and shaping the wire into the double helix, coating wire 11 with an aluminum oxide to form a layer 12 (i.e. the first coating layer) having a thickness of about 0.1 mm, further coating the same with aluminum oxide containing tungsten particles to form a dark coating layer 13, then removing the molybdenum wire by dissolving. Numeral 2 refers to a sleeve housing the dark heater 1, 3 refers to a base metal in the form of a cap covering an end of the sleeve 3, 4 refers to an electron-emissive material placed on the upper surface of the base metal 3. The electron-emissive material 4 is heated by the dark heater 1 to exit thermoelectrons.

The dark heater 1 is produced as follows: An aluminum oxide layer 12 is formed by a known method such as electrodeposition on a double helical tungsten core wire 11 prepared by coiling the tungsten core wire around a molybdenum wire and shaping the wire 11 into the double helix. Then, particles having a low adhesion strength are removed previously by washing the same with an organic solvent such as methanol. The product is dried with an IR lamp. In this step, the drying time is controlled so that 0.5 to 1.5 wt. % of volatile matters such as water remain in the aluminum oxide layer 12. The drying method is not limited and other methods such as air blowing may also be employed. Then, the heater having the aluminum oxide layer 12 formed thereon is immersed in a coating bath comprising tungsten particles and aluminum oxide and having a viscosity and specific gravity controlled to 11 cP and 1.35 (liquid temperature: 25° C.), respectively, to form a dark coating layer 13. Particles having a low adhesion strength are removed with methanol or the like in the same manner as above and the obtained product is dried with an IR lamp or the like. It is then heat-treated at a high temperature of, for example, about 1,600° C. to obtain the intended dark heater 1.

Figure 2A:
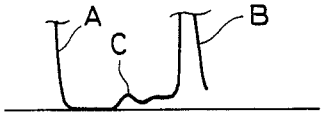
FIGS. 2*a* to 2*e* show each a tungsten dispersion in a cross-section of a heater obtained at various degrees of drying of the first coating layer.
Figure 2B:
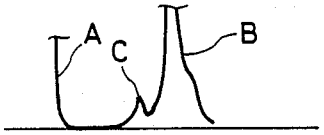
Figure 2C:
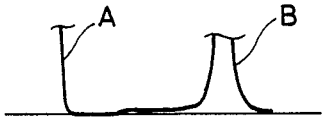
Figure 2D:
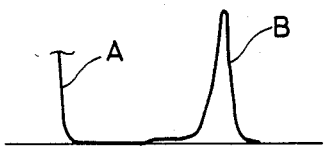
Figure 2E:
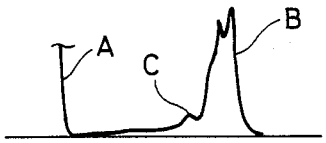
Figure 3:
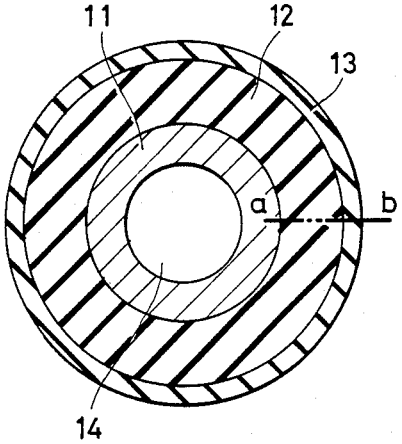
FIG. 3 is a cross-sectional view of the heater shown in FIG. 1 taken along a line III—III.

FIGS. 2*a* to 2*e* show the results of tungsten distribution in a heater produced in the same manner as above except that the degree of drying effected after the formation of the aluminum oxide layer 12 by electrodeposition was varied, the tungsten distribution being examined with an X-ray microanalyzer. FIG. 2*a* shows the results of a sample 1 which was not dried at all after the electrodeposition. FIGS. 2*b* to 2*d* show the results of the samples dried at a temperature of up to about 100° C. with three 250-W IR lamps. FIG. 2*b* shows the results of a sample 2 dried for 30 sec, FIG. 2*c* shows those of a sample 3 dried for 60 sec and FIG. 2*d* shows those of a sample 4 dried for 300 sec. FIG. 2*e* shows the results of a sample 5 sintered by heating to 1600° C. for 2.5 min. FIGS. 2*a* to 2*e* show the amount of tungsten detected along an analysis line a-b on the cross-section section taken along line III—III in FIG. 3. The abscissa represents the position on the abovementioned analysis line and the ordinate represents the amount of tungsten. In FIG. 3, numeral 14 refers to a cavity formed by removing the Mo wire, used in coiling the core 11, by dissolving. In FIGS. 2*a* to 2*e*, A and B show tungsten distributions in the tungsten core line 11 and the dark coating layer 13, respectively.

Figure 4:
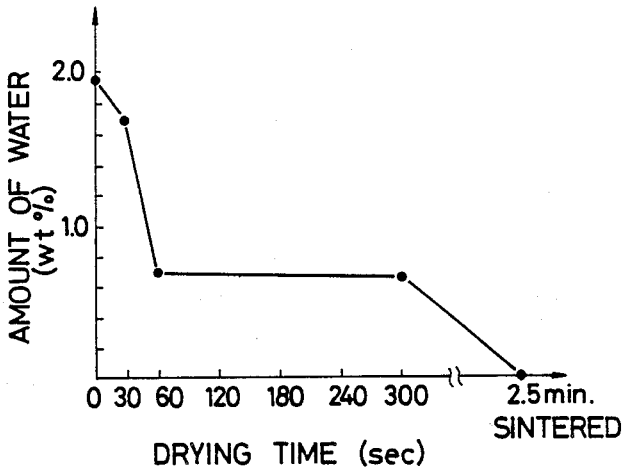
FIG. 4 is a graph showing the relationship between the degree of drying of the first coating layer and the water content.

The relationship between the degree of drying and the water content of the aluminum oxide layer 12 determined after the drying is shown in FIG. 4 and the following table. It is apparent from FIGS. 2*a* to 2*e* that the penetration of tungsten in the aluminum oxide layer 12 was not recognized at all in samples having a water content of 0.684 wt. % (FIG. 2*c*) or 0.679 wt. % (FIG. 2*d*), which such a penetration was recognized in the samples having a water content of 1.94 wt. % (FIG. 2*a*) or 1.68 wt. % (FIG. 2*b*) and the sample dried almost completely to a water content of 0.01 wt. % (FIG. 2*e*) by sintering at 1600° C. as shown by a symbol C in each figure. The results shown in FIGS. 2*a* to 2*e* are the averages of the results of the determination of five samples.

| Sample | Drying step | Volatile matter content |
|---|---|---|
| 1 | not dried | 1.94 wt. % |
| 2 | dried for 30 sec | 1.68 wt. % |
| 3 | dried for 60 sec | 0.684 wt. % |
| 4 | dried for 300 sec | 0.679 wt. % |
| 5 | sintered at 1600° C. | 0.01 wt. % |

It is apparent from the above results that the penetration of tungsten is observed when the degree of drying is low and the water content is excessive and also when the water content is insufficient and that the dark coating layer 13 is formed desirably in the presence of a suitable amount of water in order to prevent the penetration of tungsten. After detailed experiments, it was confirmed that the suitable amount of the volatile matter remaining therein is about 0.5 to 1.5 wt. % and that when the drying time is controlled so as to control the volatile matter content within this range, the penetration of the bath liquid and, therefore tungsten, in the aluminum oxide layer 12 can be prevented, though the bath having a low viscosity is used.

Though the present invention is described above with reference to the dark heater comprising the tungsten core wire, the first aluminum oxide coating layer and the tungsten-containing dark coating layer, the dark heater of the present invention is not limited thereto. For example, any of high-melting point metals used generally for heaters, such as molybdenum, may be used. The first coating layer may be made of a known, heat-resistant insulating material generally used in the production of a heater, such as zirconium oxide, beryllium oxide or a mixture of chromium oxide and titanium oxide. Though these materials have problems that they must be heated to a high temperature of about 400° C. to enhance the cost, since they per se are relatively soft and porous, the complete drying by heating to such a high temperature is unnecessary in the process of the present invention.

Further, the second coating layer can be darkened by using other substances having a high melting point and a high emissivity such as carbon, titanium, chromium and molybdenum. Also in such a case, the penetration of these materials in the first coating layer can be prevented by controlling the degree of drying of the first coating layer as described above.

As described above in detail, according to the method of the present invention wherein the dark coating layer is formed after the formation of the first coating layer of the dark heater and while 0.5 to 1.5 wt. % of volatile matter remains in the first coating layer, the cost of the drying step can be reduced and a quite even layer thickness can be obtained because the coating liquid having a low viscosity can be used. As a result, the emission characteristics of the heater can be stabilized.

Incidentally, in the method of producing a dark heater of the present invention, conventional knowledges and known teachings may be adopted in connection with matters not specifically described in the instant specification.

What is claimed is:

1. A method of producing a dark heater, which comprises the steps of coating a core wire made of a heat-resistant conductive material with a mixture containing a heat-resistant insulating material and volatile matter to obtain a first coating layer and coating the obtained first coating layer of the insulating material so that 0.5 to 1.5 wt. % of said volatile matter remains with a suspension of material containing heat-resistant particles having a high thermal emissivity to form a second coating layer and drying the second coating layer.

2. A method of producing a dark heater according to claim 1, wherein the core wire is made of a material selected from the group consisting of tungsten and molybdenum.

3. A method of producing a dark heater according to claim 1, wherein the first coating layer is made of a material selected from the group consisting of aluminum oxide, zirconium oxide, beryllium oxide and a mixture of chromium oxide and titanium oxide.

4. A method of producing a dark heater according to claim 1, wherein the particles are those of a material selected from the group consisting of tungsten, carbon, titanium, chromium and molybdenum.

5. A method of producing a dark heater according to claim 2, wherein the core wire is made of tungsten.

6. A method of producing a dark heater according to claim 3, wherein the first coating layer is made of aluminum oxide.

7. A method of producing a dark heater according to claim 4, wherein the particles are made of tungsten.

8. A method of producing a dark heater according to claim 1, wherein the core wire and the particles are made of tungsten and the first coating layer is made of aluminum oxide.

9. A method of producing a dark heater according to claim 1, wherein said material containing heat-resistant particles has a viscosity of 10–12 cp.

10. A method of producing a dark heater, which comprises the steps of coating a core wire made of a heat-resistant conductive material with a mixture of a heat-resistant insulating material and volatile matter to provide a coating layer, partially drying the coating layer to provide an insulating layer in which 0.5–1.5 weight % of the volatile matter remains, dip-coating the partially dryed coating layer into a bath containing heat-resistant particles of a high thermal emissivity to form another coating layer, the penetration of the particles into the insulating layer being prevented due to the retention of said volatile matter and thereafter drying the another coating layer.

11. A method of producing a dark heater, which comprises the steps of coating a core wire made of a heat-resistant conductive material with a mixture of a heat-resistant insulating material and volatile matter to provide a coating layer, partially drying the coating layer to provide an insulating layer in which 0.5 to 1.5 wt. % of the volatile matter remains, dip-coating the partially dried coating layer into a bath containing heat-resistant particles of a high thermal emissivity to form another coating layer, the penetration of the particles into the insulating layer being prevented due to the retention of said volatile matter and thereafter drying the another coating layer, wherein said bath containing heat-resistant particles has a viscosity of 10–12 cp.

12. A method of producing a dark heater according to claim 11, wherein said insulating material comprises aluminum oxide and said particles comprise tungsten particles.

13. A method of producing a dark heater according to claim 11, wherein the core wire is made of a material selected from the group consisting of tungsten and molybdenum.

14. A method of producing a dark heater according to claim 11, wherein the coating layer is made of a material selected from the group consisting of aluminum oxide, zirconium oxide, beryllium oxide and a mixture of chromium oxide and titanium oxide.

15. A method of producing a dark heater according to claim 11, wherein the particles are those of a material selected from the group consisting of tungsten, carbon, titanium, chromium and molybdenum.

16. A method of producing a dark heater according to claim 13, wherein the corer wire is made of tungsten.

17. A method of producing a dark heater according to claim 14, wherein the coating layer is made of aluminum oxide.

18. A method of producing a dark heater according to claim 15, wherein the particles are made of tungsten.

19. The method of producing a dark heater according to claim 11, wherein the core wire and the particles are made of tungsten, and the coating layer is made of aluminum oxide.

20. A method of producing a dark heater, which comprises the steps of electro-depositing a mixture of a heat-resistant insulating material and volatile matter on a core wire made of a heat-resistant conductive material to provide a coating layer on said core wire, partially drying the coating layer to provide an insulating layer in which 0.5 to 1.5 wt. % of the volatile matter remains, dip-coating the partially dried coating layer into a bath having a viscosity of 10 to 12 cp and containing heat-resistant particles of a high thermal emissivity to form another coating layer, the penetration of the particles into the insulating layer being prevented due to the retention of said volatile matter and thereafter drying the another coating layer.

21. A method of producing a dark heater according to claim 20, wherein the core wire is made of a material selected from the group consisting of tungsten and molybdenum.

22. A method of producing a dark heater according to claim 20, wherein the coating layer is made of a material selected from the group consisting of aluminum oxide, zirconium oxide, beryllium oxide and a mixture of chromium oxide and titanium oxide.

23. A method of producing a dark heater according to claim 20, wherein the particles are those of a material selected from the group consisting of tungsten, carbon, titanium, chromium and molybdenum.

24. A method of producing a dark heater according to claim 21, wherein the core wire is made of tungsten.

25. A method of producing a dark heater according to claim 22, wherein the coating layer is made of aluminum oxide.

26. A method of producing a dark heater according to claim 23, wherein the particles are made of tungsten.

27. A method of producing a dark heater according to claim 20, wherein the core wire and the particles are made of tungsten, and the coating layer is made of aluminum oxide.

28. A method of producing a dark heater according to claim 10, wherein the core wire is made of a material selected from the group consisting of tungsten and molybdenum.

29. A method of producing a dark heater according to claim 10, wherein the coating layer is made of a material selected from the group consisting of aluminum oxide, zirconium oxide, beryllium oxide and a mixture of chromium oxide and titanium oxide.

30. A method of producing a dark heater according to claim 10, wherein the particles are those of a material selected from the group consisting of tungsten, carbon, titanium, chromium and molybdenum.

31. A method of producing a dark heater according to claim 28, wherein the core wire is made of tungsten.

32. A method of producing a dark heater according to claim 29, wherein the coating layer is made of aluminum oxide.

33. A method of producing a dark heater according to claim 30, wherein the particles are made of tungsten.

34. A method of producing a dark heater according to claim 10, wherein the core wire and the particles are made of tungsten, and the coating layer is made of aluminum oxide.

* * * * *